US007823301B2

(12) United States Patent
Belluto

(10) Patent No.: US 7,823,301 B2
(45) Date of Patent: Nov. 2, 2010

(54) SPORTS SHOES, IN PARTICULAR FOR PLAYING GOLF

(75) Inventor: Daniele Belluto, Turin (IT)

(73) Assignee: db ONE S.R.L., Turin (IT)

( * ) Notice: Subject to any disclaimer, the term of this patent is extended or adjusted under 35 U.S.C. 154(b) by 849 days.

(21) Appl. No.: 11/573,388

(22) PCT Filed: Aug. 8, 2005

(86) PCT No.: PCT/IB2005/002372

§ 371 (c)(1),
(2), (4) Date: Apr. 17, 2007

(87) PCT Pub. No.: WO2006/016254

PCT Pub. Date: Feb. 16, 2006

(65) Prior Publication Data

US 2007/0240337 A1 Oct. 18, 2007

(30) Foreign Application Priority Data

Aug. 10, 2004 (IT) ..... TO2004A0563

(51) Int. Cl.
*A43B 5/00* (2006.01)

(52) U.S. Cl. ..... 36/127; 36/134

(58) Field of Classification Search ..... 36/127, 36/134, 103, 8.3
See application file for complete search history.

(56) References Cited

U.S. PATENT DOCUMENTS

| | | | | |
|---|---|---|---|---|
| 1,857,975 | A * | 5/1932 | Reynolds | 36/73 |
| 2,109,712 | A * | 3/1938 | Schmalz | 36/8.3 |
| 3,081,562 | A * | 3/1963 | Oakley | 36/8.3 |
| 3,091,043 | A * | 5/1963 | Mccorkle | 36/136 |
| 3,204,348 | A * | 9/1965 | Latson | 36/8.3 |
| 4,149,324 | A | 4/1979 | Lesser et al. | |
| 4,161,829 | A | 7/1979 | Wayser | |
| 4,885,851 | A | 12/1989 | Peterson | |
| 4,937,954 | A | 7/1990 | Clement | |
| 4,953,311 | A | 9/1990 | Bruggemeier | |
| 5,638,615 | A | 6/1997 | Korsen | |
| 5,943,794 | A | 8/1999 | Gelsomini | |
| 2003/0056394 | A1 * | 3/2003 | Yu | 36/8.3 |
| 2003/0188459 | A1 | 10/2003 | Kelly et al. | |
| 2004/0040182 | A1 | 3/2004 | McMullin | |
| 2009/0113761 | A1 * | 5/2009 | Goldberg | 36/103 |

FOREIGN PATENT DOCUMENTS

| | | |
|---|---|---|
| DE | 100 00 472 | 7/2000 |
| DE | 102 32 033 | 2/2003 |
| FR | 2 828 792 | 2/2003 |
| GB | 2 377 616 | 1/2003 |
| WO | 00 64294 | 11/2000 |

* cited by examiner

*Primary Examiner*—Marie Patterson
(74) *Attorney, Agent, or Firm*—Oblon, Spivak, McClelland, Maier & Neustadt, L.L.P.

(57) ABSTRACT

A sports shoe or a pair of asymmetric shoes, in particular for playing golf, including a sole fitted with a rotation mechanism to rotate independently of the sole. The rotation mechanism includes a first rotary disc substantially located in the shoe section intended to receive the big toe of a foot.

30 Claims, 8 Drawing Sheets

Fig. 10a

SPORTS SHOES, IN PARTICULAR FOR PLAYING GOLF

The present invention relates to sports shoes according to the preamble of claim 1.

In some sports, like golf, balance is a very important factor.

With reference to golf, in order to send the ball toward the hole from a long distance, the player performs a swing action, i.e. a complex movement which involves almost all main articulations of the human body (shoulders, elbows, knees, ankles, feet) and by which the player whirls the club to hit the ball and send it toward the hole. Balance, understood as controlled management of all forces around the individual, is absolutely fundamental during this swing action.

As known, the foot plays a very important role in the search for balance because, apart from representing the means supporting the body on the ground, it also works as a sensor providing an essential source of useful information to the player's balance and stance adjustment system. In sports where balance is important, shoes (which contain the foot) play an important role as well, and therefore have always been subject to improvements.

The invention relates specifically to asymmetric shoes, in particular for playing golf, and more precisely to shoes intended either for right-handed players or for left-handed players, wherein the right shoe has technical and constructive characteristics them being different from those of the left shoe.

The U.S. Pat. No. 4,953,311 discloses an asymmetric design which optimizes the different functions carried out by a golfer's foot, so as to improve balance during a swing action. The asymmetry essentially consists in a different design of the arch support of the right and left shoes.

However, this type of shoes turns out to be rather uncomfortable when the player has to walk. A number of patents, such as U.S. Pat. Nos. 5,566,478, 3,354,561 and FR 2 828 792, describe sports shoes whose sole comprises a rotary disc it being independent of the sole. This solution is used for golf shoes and, more in general, for spiked shoes, in order to facilitate the rotation of a supporting foot, i.e. a foot supporting most of the body weight.

These shoes however have a drawback, in that the rotary disc must be large and rather rigid in order to support the body weight, so these shoes are somewhat uncomfortable for walking.

The main object of the present invention is to overcome the drawbacks and problems of sports shoes according to the prior art.

A further object of the present invention is to provide asymmetric sports shoes, in particular for playing golf, them being highly effective and easy to manufacture.

A further object of the present invention is to provide asymmetric sports shoes, in particular for playing golf, them being effective during a swing action and allowing to walk comfortably.

These and other objects of the present invention are accomplished through sports shoes, in particular for playing golf, them having the features of the annexed claims, which form an integral part of the present description.

Further objects, features and advantages of the present invention will become apparent from the following detailed description, provided as a non-limiting example, and from the annexed drawings, wherein.

Figure 9A:
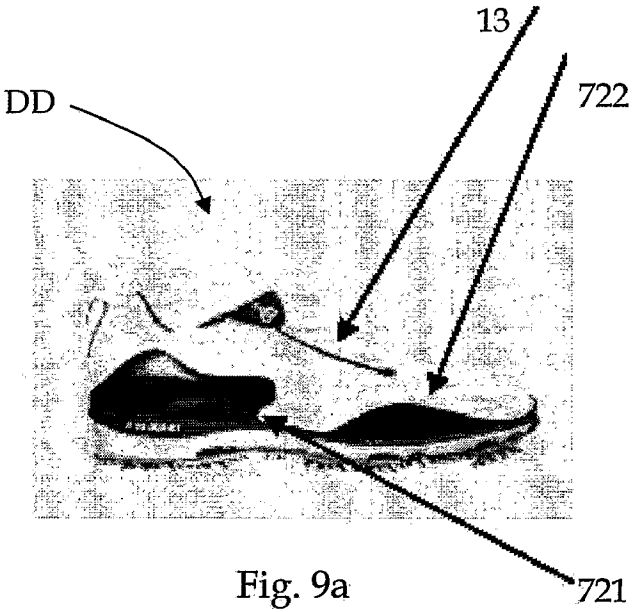
Figure 9C:
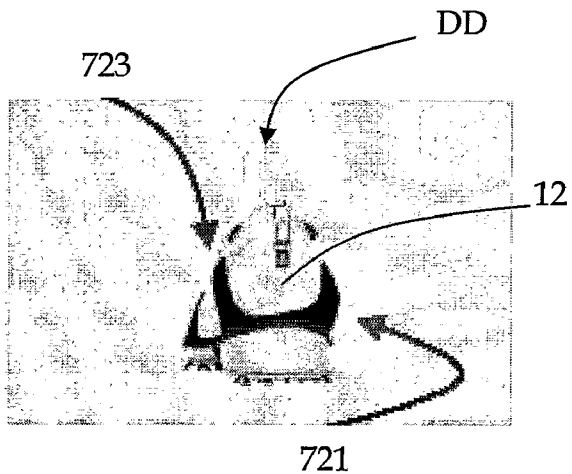
Figure 9B:
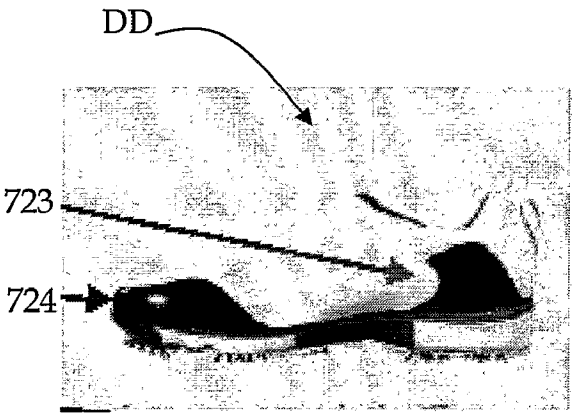
Figure 10B:
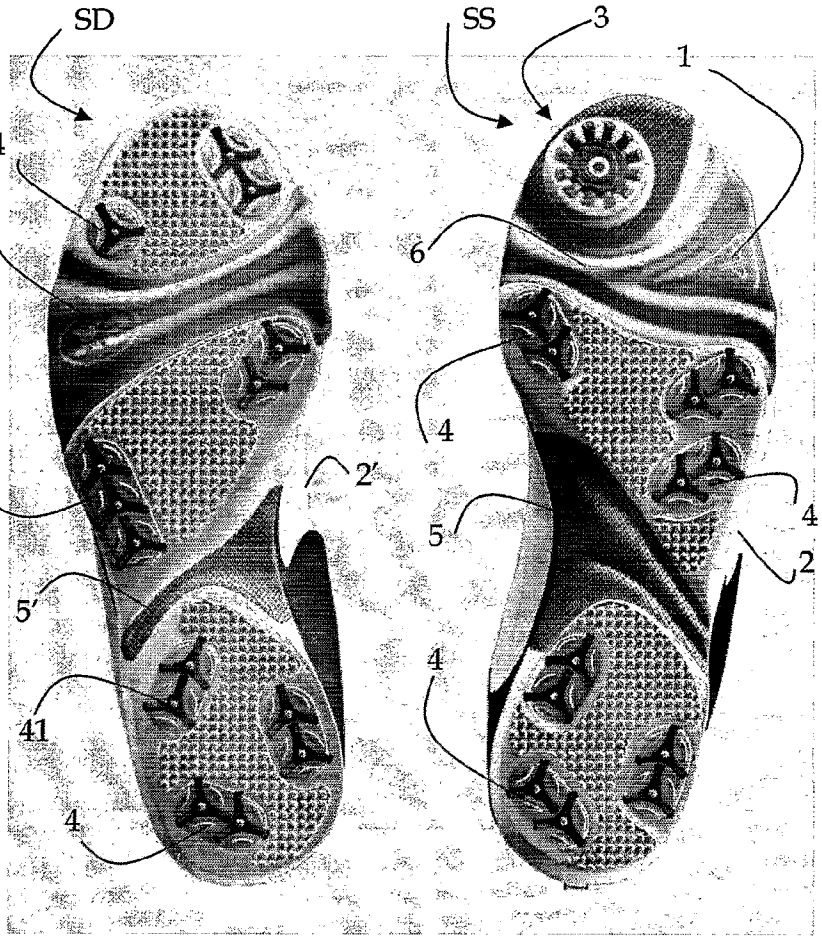
Figure 10A:
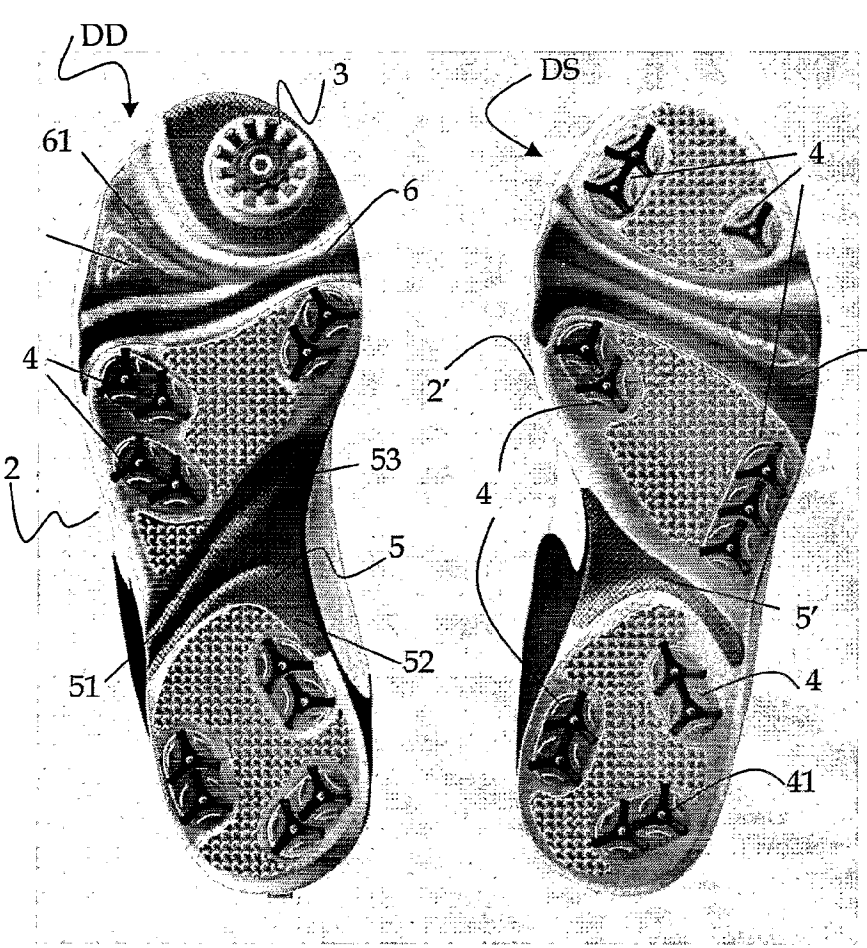
Figure 11B:
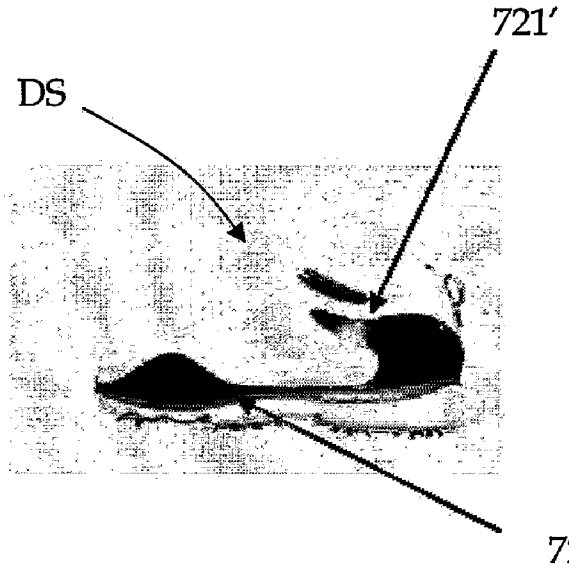
Figure 11A:
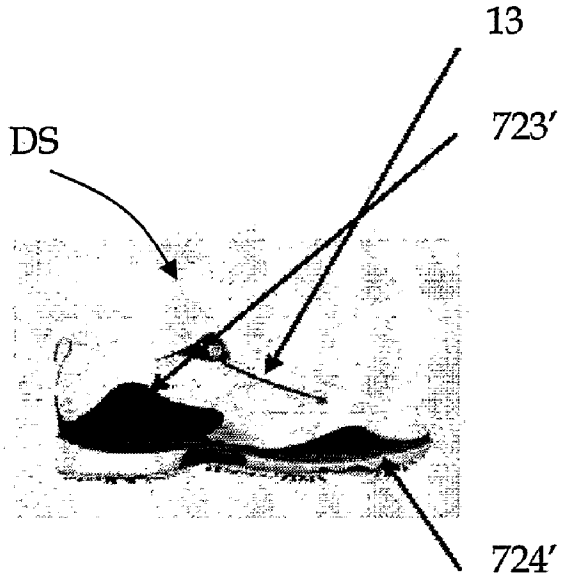
Figure 12A:
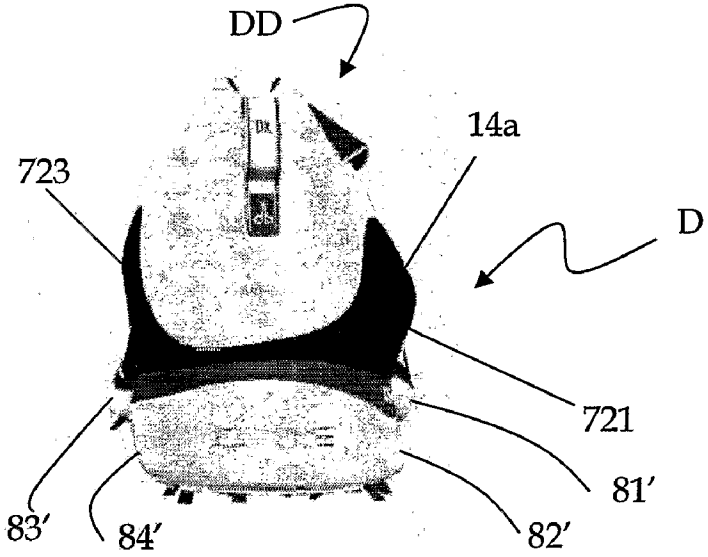
Figure 12A:
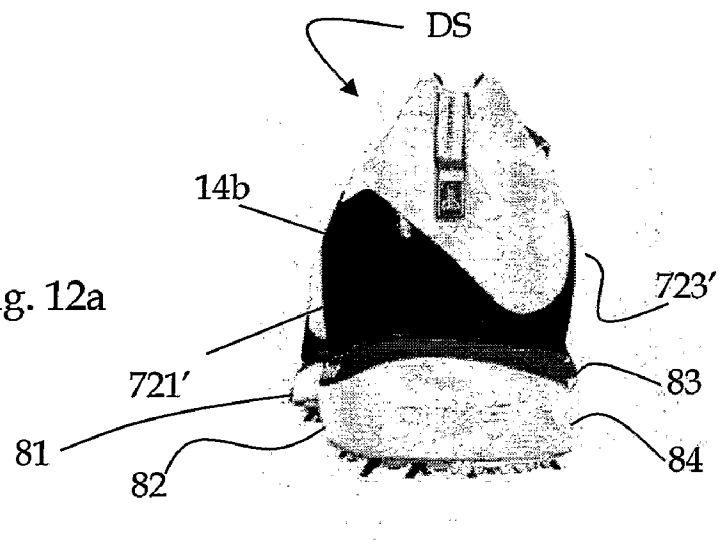
Figure 12B:
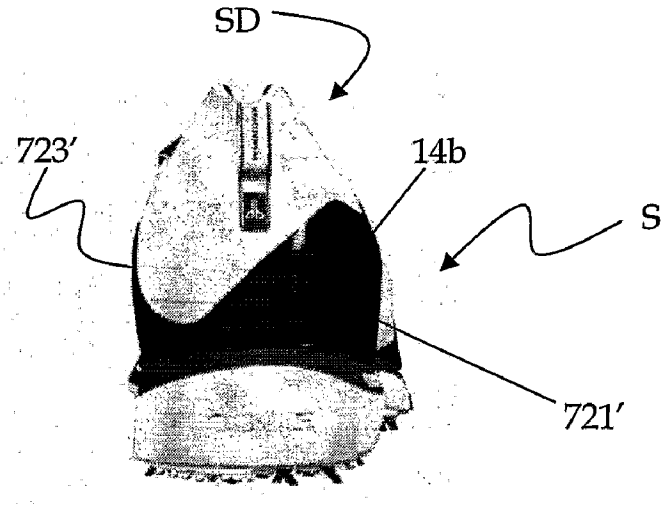
Figure 12B:
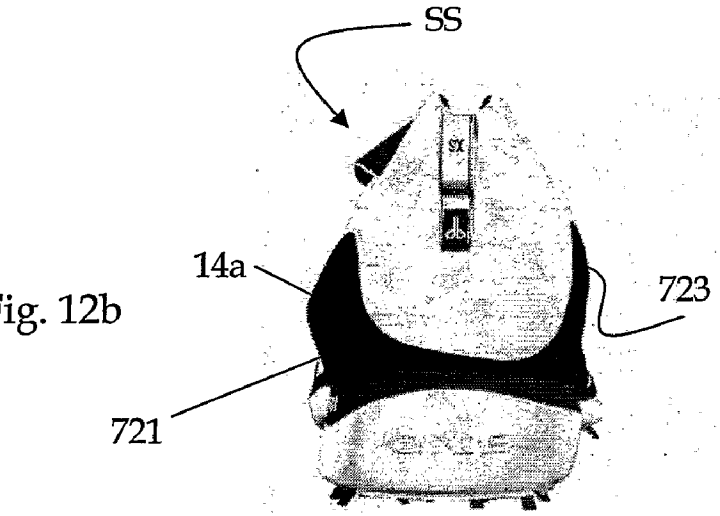
Figure 13A:
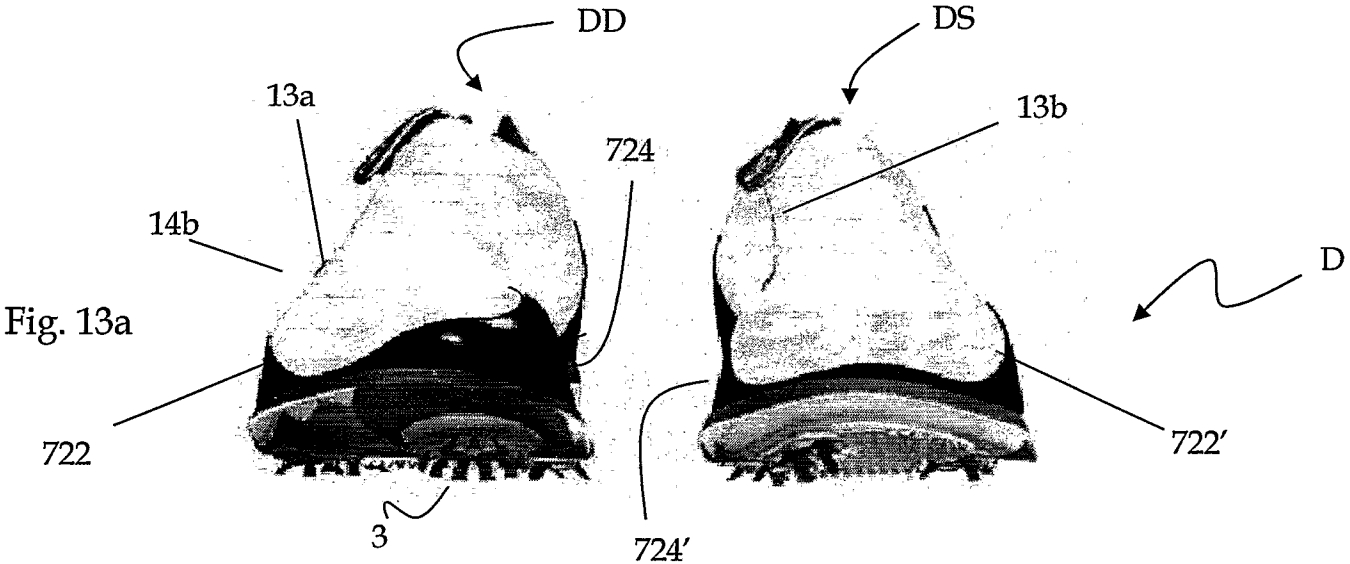
Figure 13B:
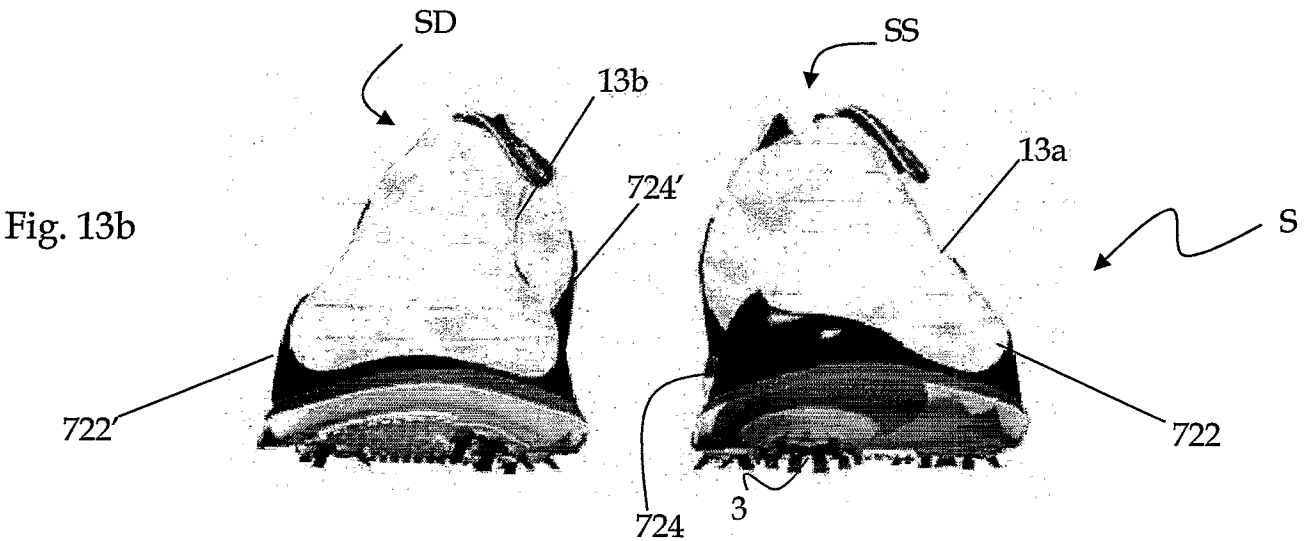

FIGS. 9*a*, 9*b* and 9*c* show two side views and one rear view, respectively, of a right shoe for right-handed people according to the invention;

FIGS. 10*a*, 10*b* show a bottom view of a pair of shoes for right-handed and left-handed people, respectively, according to the invention;

FIGS. 11*a*, 11*b* show two side views of a left shoe for right-handed people according to the invention;

FIGS. 12*a* and 12*b* show rear views of a pair of shoes for right-handed people and of a pair of shoes for left-handed people, respectively, according to the invention;

FIGS. 13*a* and 13*b* show front views of a pair of shoes for right-handed people and of a pair of shoes for left-handed people, respectively, according to the invention.

The sports shoes described below as a non-limiting embodiment example may specifically be applied to golf, but it is clear that the same shoes, possibly with some small variations, may also be used for other sports wherein the foot needs to performs essentially the same movements being required when playing golf.

With reference to the drawings, wherein equal or equivalent parts are indicated with the same reference numbers or letters, D identifies a first pair of shoes for right-handed people, i.e. people who, when playing golf, perform the swing action by turning about the right foot, DD identifies the right shoe of the first pair of shoes D for right-handed people, and DS identifies the left shoe of the first pair of shoes D for right-handed people.

S identifies a second pair of shoes for left-handed people, i.e. people who, when playing golf, perform the swing action by turning about the left foot, SD identifies the right shoe of the second pair of shoes S for left-handed people, and SS identifies the left shoe of the second pair of shoes S for left-handed people.

According to the invention, a sports shoe, in particular for playing golf, comprises a sole fitted with rotation means which can rotate independently of said sole; inventively speaking, said rotation means comprise a first rotary disc it being located in the shoe section intended to receive the big toe of a foot.

Figure 1:
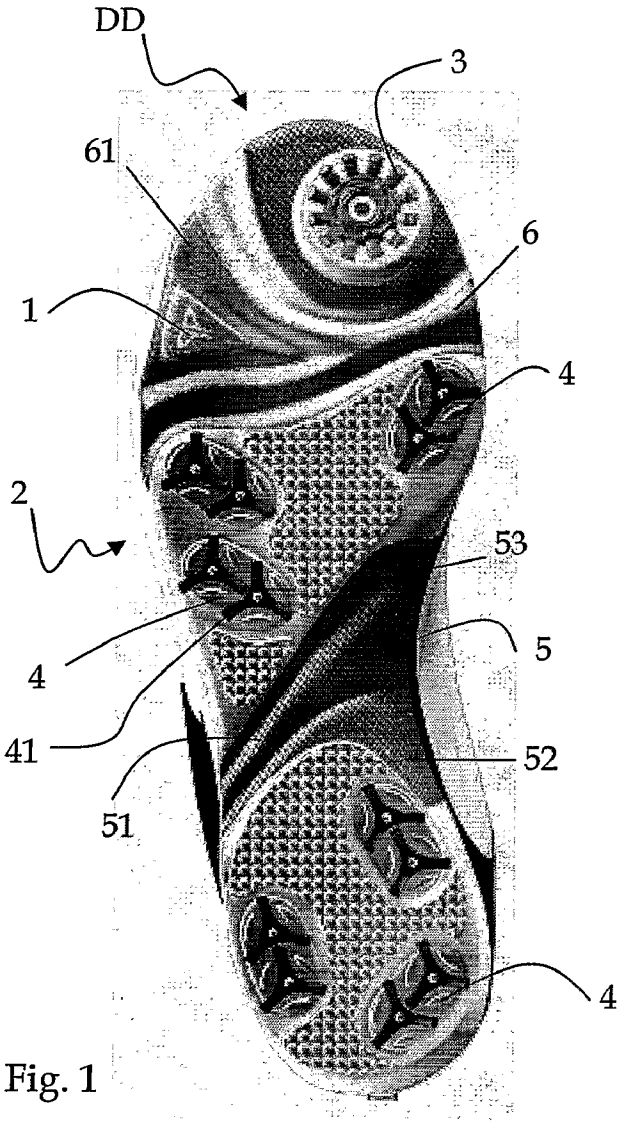
FIG. 1 shows a bottom view of a right shoe for right-handed people according to the invention.

FIG. 1 shows a bottom view of the sole 2 of a right shoe DD for right-handed people according to a first embodiment of the invention.

Figure 2:
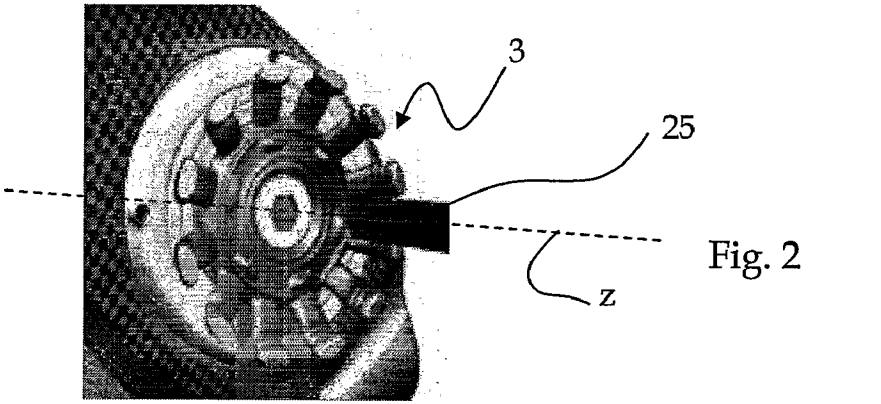
FIG. 2 shows a detail of the shoe of FIG. 1, representing a first embodiment of a rotation means of the shoe according to the invention.
Figure 3:
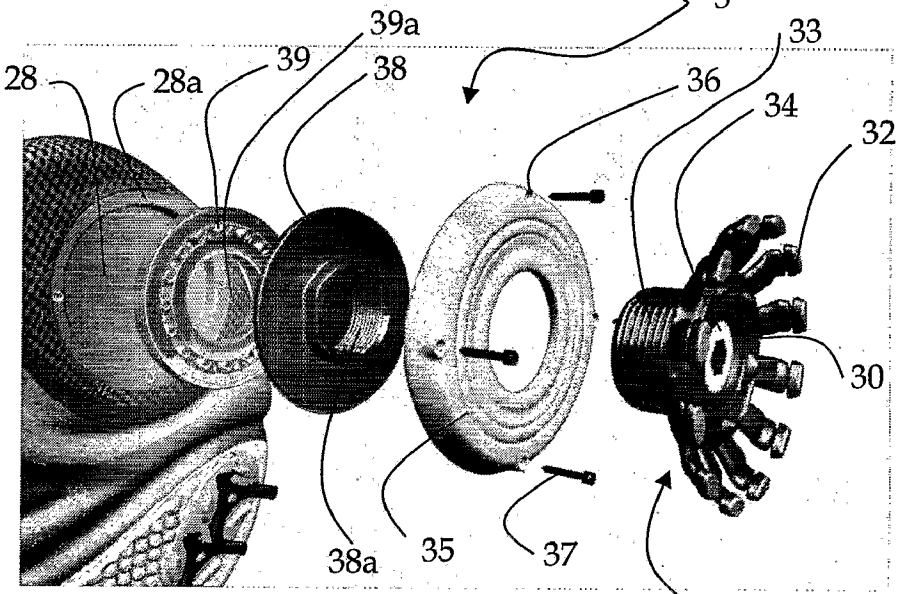
FIG. 3 shows an exploded view of the rotation means of FIG. 2.

In the front area of the shoe DD, in the shoe section intended to receive the big toe of a foot, i.e. in the area where the big toe will rest when the foot is in the shoe, there is a rotation means 3, which is more clearly visible in FIGS. 2 and 3.

The elements composing the rotation means 3 will now be described in detail with particular reference to FIG. 3.

In particular, the rotation means 3 is a rotary disc comprising an octopus-shaped ground grip element 31 fitted with a threaded head 33 joined to a discoid element 30, from which a plurality of elastic supports 32 branch off, in particular elastic arms, being preferably equidistant.

At the centre of the grip element 31 there is a hinge 34 having a hole, e.g. an hexagonal hole, adapted to receive an Allen key 25, shown in FIG. 2, allowing the grip element 31 to be replaced, if necessary.

The rotation means 3 also comprises a circular crown 38 having a threaded circular hole 38*a* on which the threaded head 33 of the grip element 31 can be screwed.

A bearing 39, also having a central circular hole 39*a*, is interposed between a concave circular area 28, obtained in the front portion of the sole 2 in the shoe section housing the big toe, and the circular crown 38.

The grip element 31 is fastened to the sole 2 through a fastening disc 35 having circumferential holes 36, which are aligned on matching peripheral holes 28*a* in the concave circular area 28 of the sole 2, and through fastening means 37, e.g. screws, inserted through the holes 36,28*a*.

As a matter of fact, the rotation means 3 represents a "rotary spike", i.e. a support protruding from the surface of the sole 2 which, during the swing action, rests on the ground, thereby allowing for an easier rotation of the foot.

Advantageously, the grip element 31 can be easily removed from the sole 2 by using the Allen key 25 on the hinge 34. Therefore, a plurality of grip elements 31 may be provided, each being suitable for different types of surfaces. Preferably, the grip elements 31 are produced in at least three versions made of materials having different density, according to the ground on which the shoe is to be used.

According to a preferred embodiment, the "rotary spike" 3 allows for a 360° rotation.

Advantageously, the sole 2 is fitted with at least one second rotation means. According to an embodiment shown in FIG. 1 and more clearly visible in FIG. 4, said second rotation means is a spike 4 comprising at least one anchor-shaped element 41.

The anchor-shaped element 41 can move independently of the sole 2, in particular said anchor-shaped element 41 can rotate.

Said second rotation means 4 comprises stopping means 42 adapted to block the movement of said anchor-shaped element 41.

Figure 4:
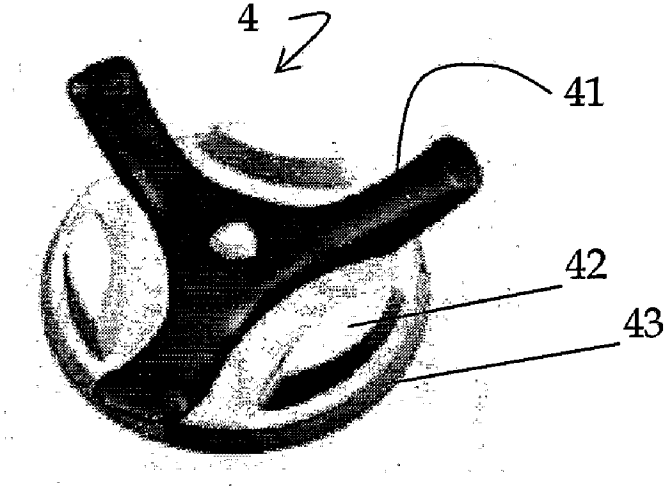
FIG. 4 shows a second embodiment of a rotation means of the shoe according to the invention.

In the embodiment of FIG. 4, said stopping means 42 consist of protrusions being over-moulded to a body 43 of said spike 4.

According to different embodiments, the body 43 is attached to the sole 2 and is obtained as an integral part of the sole during the over-moulding of the sole 2 itself. The anchor-shaped element 41 is fastened to the body 43 through suitable fastening means, e.g. a screw.

Figure 5:
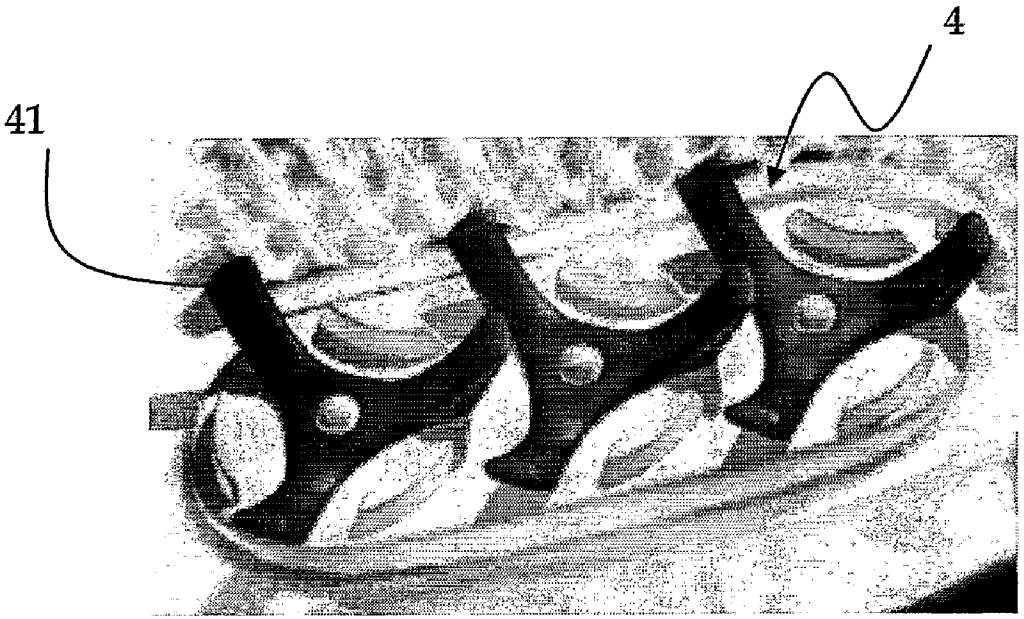
FIG. 5 shows a third embodiment of a rotation means of the shoe according to the invention.

FIG. 5 shows a different embodiment of said second rotation means 4; in this embodiment, the rotation means is a spike 4 comprising three anchor-shaped elements 41.

In another embodiment of said second rotation means 4, as shown in FIG. 1 in the central area of the shoe DD, the rotation means is a spike 4 comprising two anchor-shaped elements 41.

According to the invention, a shoe may comprise spikes 4 having a different number of anchor-shaped elements 41; thus spikes having different lengths may be used for supporting different areas of the foot. The choice of the spike 4 preferably depends on the movement to be performed by the foot and on the shape of the foot bone resting on the spike 4 during some of the movements required by the sport for which the shoes are being designed, e.g. a swing action in the case of golf shoes.

There is also a further spike 1 having a triangular shape and being located in the front section of the sole 2 in the shoe section covering the fourth, fifth and part of the third toes of the foot.

Said spike 1 has a base being substantially parallel to the edge of the sole 2 and its vertex being opposite to the base is directed toward the inside of the sole 2. The spike 1 offers anteropodalic stabilization in both the deambulation and swinging phases.

Advantageously, the sports shoe according to the invention comprises further means which improve the comfort of the foot and follow it during its torsion and flexure movements.

In FIG. 1, the shoe DD has a torsional stabilizer 5 substantially located at the centre of said sole 2, in particular in the mesopodalic area.

On the outside, the torsional stabilizer 5 substantially has a Y shape, with two branches 51 and 52 directed toward the area of the sole 2 intended to receive the heel of the foot, and a branch 53 directed toward the area of the sole intended to receive the base of the first metatarsus of the foot.

More precisely, the torsional stabilizer element 5 has a shape being suitable for following the torsional axiality of a foot under load during a swing action performed by a golf player, i.e. the right foot of a right-handed player or the left foot of a left-handed player.

According to a preferred embodiment, the torsional stabilizer element 5 is made of a material, preferably carbon, having a higher rigidity than the material of the base of the sole 2, i.e. the outer part of the sole of the shoe DD on which the spikes 4 are mounted or over-moulded.

The use of a more rigid material than that employed for the base of the sole allows to stabilize the sole 2 during the torsion of the foot and of the shoe.

Preferably, the shoe DD also comprises a flexure elastic element 6 located in the upper half of said sole 2 and crossing said sole 2 in a direction being transversal to the foot. This element is used to facilitate the flexure of the shoe in the metatarsus-phalanx area.

The flexure elastic element 6 of FIG. 1 comprises an elastic segment 61 which substantially starts from the centre of the flexure elastic element 6 and then extends by following a curved line being suitable for following the torsion of a foot under load during a swing action performed by a golf player.

Preferably, said elastic segment 61 is directed toward the section of the sole 2 intended to receive the fourth toe.

Figure 6:
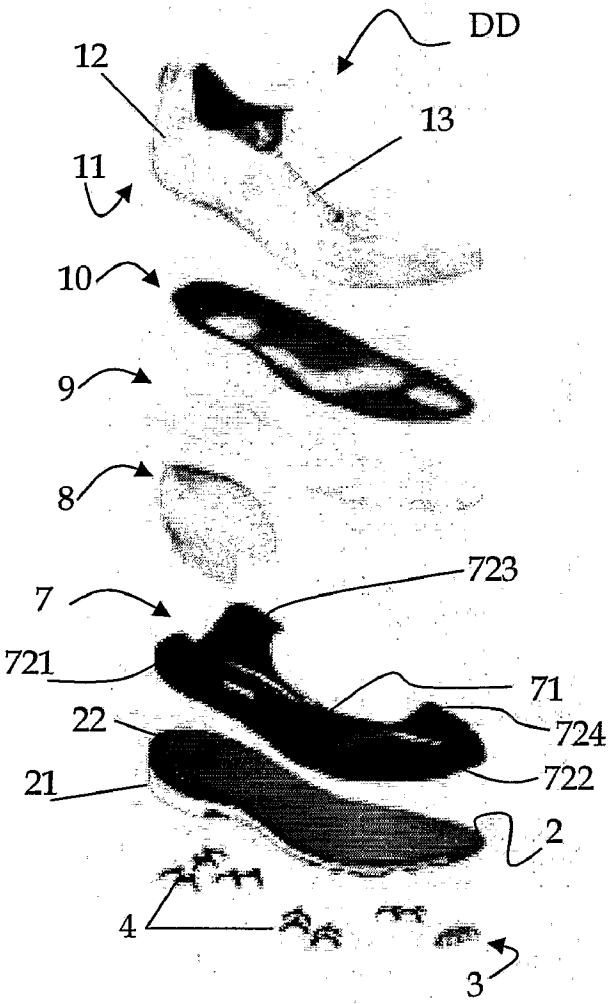
FIG. 6 shows an exploded view of a shoe according to an embodiment of the invention.

FIG. 6 shows an exploded view of a right shoe DD for right-handed people.

Starting from the bottom of the shoe DD, the items shown are as follows:

- the set of spikes 3,4, comprising the rotary disc 3 and the spikes 4 with anchor-shaped elements;
- the sole 2, preferably consisting of two layers 21 and 22 made of two different materials, in particular the upper layer 22 being softer than the lower layer 21;
- a vamp stabilizer 7;
- a heel sock 8 for stabilizing a heel-ankle shell 12;
- a vamp bottom 9;
- an ergonomic plantar interface 10;
- a vamp 11;
- a fastening means 13.

Figure 7:
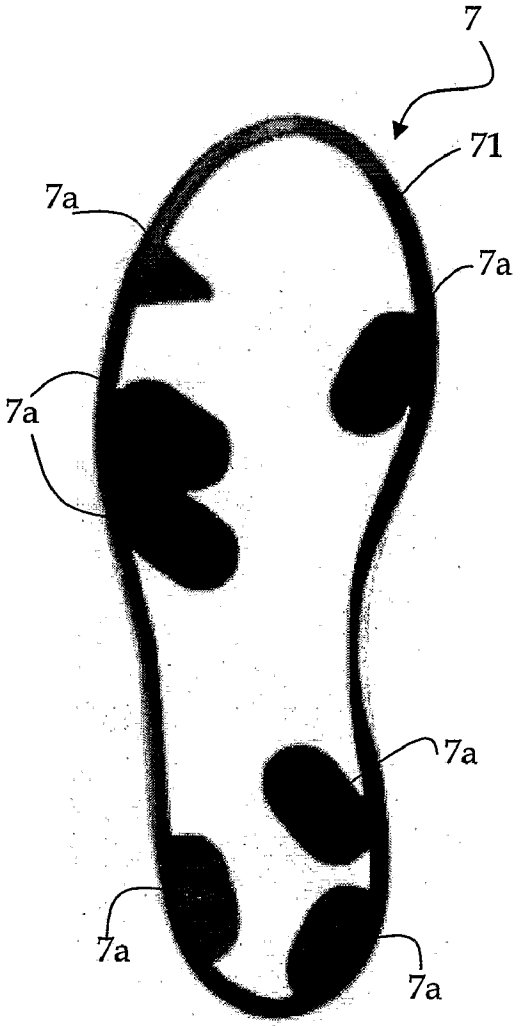
FIG. 7 shows a vamp stabilizer for a shoe according to the invention.

With reference to FIG. 7, the stabilizer 7 of the vamp 11 is adapted to oppose the bending of the vamp 11 in one or more areas of said vamp 11.

The stabilizer 7 of the vamp 11 comprises a peripheral edge 71, which is fastened to the sole 2, and profiles 721, 722, 723, 724 rising from said edge 71 to envelop the vamp 11 in appropriate places and thus limit its bending.

In order to exert its function, the stabilizer 7 is composed of a number of elements being made of different materials, the edge 71 being soft near the foot support area and the profiles 72 being sufficiently rigid to accomplish the stabilization of the vamp 11.

According to a preferred embodiment, the vamp stabilizer 7 is manufactured as a moulded item made of a single material. The moulded item is then bent, so that the profiles 72 rise from the base to stabilize the vamp 11.

The moulded item is made in such a way that the stabilizer 7 of the vamp 11 has a concave base which is attached onto said sole; if the latter has two layers 21 and 22, the base of the stabilizer 7 will rest on the upper layer 22 of the sole.

The stabilizer 7 of the vamp 11 also has areas 7*a* having a shape and a position matching the shape and position of the spikes 1 and 4, as clearly visible by comparing FIGS. 1 and 7.

Figure 8:
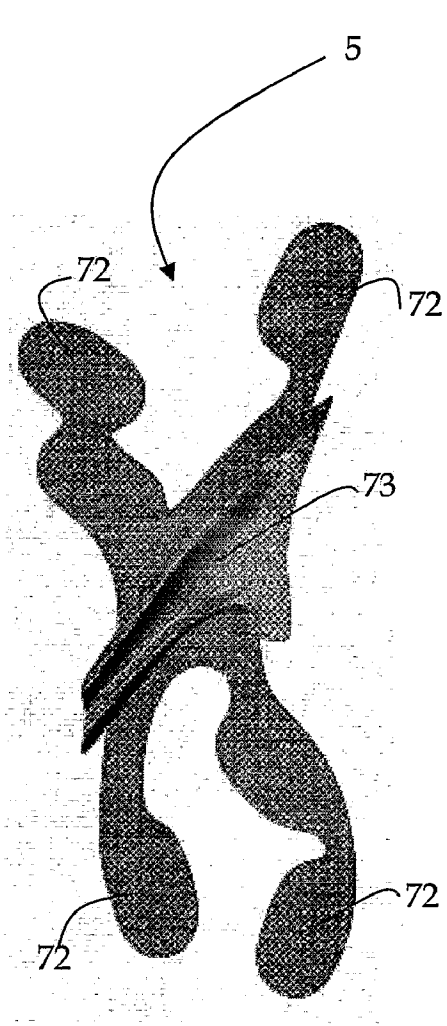
FIG. 8 shows a torsional bar for a shoe according to the invention.

In FIGS. 1 and 8, a moulded carbon torsional bar 5 is shown.

The torsional stabilizer element 5 of FIG. 8 substantially has an X shape, with a central area 73 being both the base of the stabilizer 7 of the vamp 11 and at the same time the torsional stabilizer element 5.

Carbon has been chosen due to its dynamic/physical characteristics, which allow to obtain torsional stabilization.

From the central area 73 four profiles 72 depart which, once folded, allow to control the bending forces acting on the sole 2/vamp 11. In this respect, one may notice that the shape and position of the profiles 72 substantially match the shape and position of the profiles 7*a* of the stabilizer 7 of the vamp 11.

In particular, said bending of the vamp 11 is blocked in the area of the first and/or fifth metatarsus and/or of the phalanx and/or of the inner and outer sides of the heel.

Advantageously, the four profiles 72 of the torsional stabilizer element 5 convey the forces toward the central area 73 of the stabilizer element 5.

The vamp stabilizer 7, on which the profiles 72 of the torsional stabilizer element 5 are folded, thus envelops both the sole 2 and the vamp 11, thereby contributing to keeping them joined together.

FIGS. 9*a*, 9*b* and 9*c* show different perspective views of the shoe DD according to the invention.

FIG. 9*a* shows the outer side of the shoe DD, wherein one can see a fastening means 13 and the profiles 721 and 722 of the vamp stabilizer 7, which block the bending of the vamp 11 respectively in the area of the outer side of the heel, where the stabilizer 7 performs a first posterolateral calcaneal-cuboidal inversion stabilization function, and in the area of the fifth metatarsus, where the stabilizer 7 performs an anterolateral metatarsal inversion stabilization function.

FIG. 9*b* shows the inner side of the shoe DD, wherein one can see the profiles 723 and 724 of the vamp stabilizer 7, which block the bending of the vamp 11 respectively in the area of the inner side of the heel, where the stabilizer 7 performs a first retropodalic subastragalar anti-eversion stabilization function, and in the area of the first metatarsus and of the phalanx, where the stabilizer 7 performs an anteropodalic first metatarsophalangeal anti-eversion stabilization function.

FIG. 9*c* shows the rear side of the shoe, in particular the shell 12, wherein one can see the profiles 721 and 723 of the vamp stabilizer 7, which block the bending of the vamp 11 respectively in the area of the outer side of the heel, where the stabilizer 7 performs a second posteromedial eversion stabilization function, and in the area of the inner side of the heel, where the stabilizer 7 performs a second posterolateral inversion stabilization function.

Another object of the present invention is to provide a pair of sports shoes comprising a first shoe being made as described above, and a second shoe comprising a sole being asymmetric with respect to the sole of said first shoe.

In the following embodiment example, said first shoe corresponds to a golf shoe for the foot under load during a swing action.

With reference to FIGS. 10*a*, 10*b*, identical elements are indicated with the same numbers, so that the above-described teachings concerning a pair of shoes for right-handed people may be immediately transferred to the making of a pair of shoes for left-handed people.

The asymmetry between said first and said second shoes may comprise, alternately or jointly, a series of elements like:

spikes 1,4;
torsional stabilizer element 5;
flexure element 6;
vamp stabilizer 7;
shell 12;
fastening means 13.

FIG. 10*a* shows a bottom view of a pair of shoes according to the invention; more specifically the example of FIG. 10*a* refers to a pair of shoes D for right-handed people.

The right shoe DD is intended to receive the right foot of a golf player and has all those elements, including the rotation means 3, the spikes 1,4, the torsional stabilizer element 5 and the flexure element 6, which have been described with reference to FIGS. 1 to 9.

A left shoe DS, intended to receive the left foot, comprises a sole 2' fitted with a plurality of spikes 4, each of which comprises at least one anchor-shaped element 41, being mobile independently of the sole, and stopping means 42 adapted to stop the movement of said anchor-shaped element 41.

In FIG. 10*a*, the left shoe DS is fitted with spikes 4 having one, two or three anchor-shaped elements 41. The layout of the spikes 4 ensures an appropriate support of the foot in all positions it takes during its functions.

In particular, in the right shoe DD the spikes 4 are positioned in the area of the fourth and fifth metatarsus, of the calcaneal anatomic periphery and of the base of the first metatarsus, whereas in the left shoe DS they are in the area of the base of the first metatarsus, of the calcaneal anatomic periphery, of the fifth metatarsus, of the fourth toe and of the big toe.

Compared to the right shoe DD, the left shoe DS comprises a torsional stabilizer element 5' and a flexure elastic element 6' having a different shape from the corresponding element 5,6 of the right shoe DD.

In particular, the torsional stabilizer element 5' covers a smaller area of the sole 2 in comparison with the corresponding element 5 of the right shoe DD, whereas the element 6' does not have a "Y" shape, unlike the corresponding element 6, but is simply a more transversal band.

The shape difference between the elements 5,6 of the shoe DD and the elements 5',6' of the shoe DS is due to the different functions performed by the two feet for keeping one's balance in the sport for which the shoes have been designed, i.e. golf in this example. In particular, the right shoe DD is the one on which right-handed people rotate when they perform the swing action being typical of golf.

FIG. 10*b* shows a bottom view of a pair of shoes S for left-handed people, wherein the left shoe SS has the characteristics described above for the right shoe DD of a pair of shoes D for right-handed people, and likewise the right shoe SD for left-handed people has the same characteristics as a left shoe DS for right-handed people.

According to the invention, there is asymmetry not only between two shoes of the same pair of shoes, for right-handed or left-handed people, but also between a pair of shoes for right-handed people and a pair of shoes for left-handed people.

Again with reference to a pair of shoes D for right-handed people, FIGS. 11*a* and 11*b* show a left shoe for right-handed people DS under different perspectives; in these illustrations, the stabilizer 7' of the vamp 11 is visible from different angles.

The vamp stabilizer 7' of the left shoe DS is adapted to oppose the bending of the vamp 11 in one or more areas of said vamp, and has a different shape compared to the vamp stabilizer 7 of the right shoe DD.

The vamp stabilizer 7' of the left shoe DS blocks the bending of the vamp in a lateromedial and/or metatarsal-calcaneal direction.

FIG. 11*a* shows the outer side of the left shoe DS, wherein one can see the profiles 723' and 724' of the vamp stabilizer 7', which block the bending of the vamp 11 respectively in the area of the outer side of the heel, where the stabilizer 7' performs a first submalleolar inversion stabilization function, and in the area of the fifth metatarsus, where the stabilizer 7' performs an ismatic fifth metatarsal inversion stabilization function.

FIG. 11*b* shows the inner side of the shoe DS, wherein one can see the profiles 721' and 722' of the vamp stabilizer 7', which block the bending of the vamp 11 respectively in the area of the inner side of the heel, where the stabilizer 7' performs a first retropodalic subastragalar anti-eversion stabilization function, and in the area of the first metatarsus, where the stabilizer 7' performs an anteropodalic first metatarsal anti-eversion stabilization function.

A further difference between two shoes of a pair of shoes according to the invention is the shape of the vamp stabilizer 7.

With reference to FIG. 12*a*, the first shoe DD, i.e. the right shoe for right-handed people, or the left shoe SS for left-handed people, comprises, according to the invention, a vamp stabilizer 7 having a concavity 14*a* at the level of the outer side of the heel, which concavity is sharper than a corresponding concavity 14*b* being present in the vamp stabilizer 7' of the second shoe DS,SD.

Moreover, the profile of the sole 2 has different slopes on the inner and outer sides. By way of example, the left shoe for right-handed people DS of FIG. 12*a* and SD of FIG. 12*b* have wedge-shaped outer front 81 and inner rear 84 profiles of the sole 2, whereas, vice versa, they have rounded inner front 83 and outer rear 82 profiles of the sole 2.

Vice versa, the shoes DD of FIG. 12*a* and SS of FIG. 12*b* have rounded outer front 81' and inner rear 84' profiles of the sole 2, whereas, vice versa, they have wedge-shaped inner front 83' and outer rear 82' profiles of the sole 2.

A rounded profile of the sole 2 promotes the eversion or inversion movement, whereas a wedge-shaped profile stabilizes said movement.

Similar considerations apply to the shoes DD, SD and SS.

FIGS. 13*a* and 13*b* show front views of a pair of shoes D for right-handed people and of a pair of shoes S for left-handed people, respectively.

In these illustrations, identical elements are indicated with the same numbers, so that the above-described teachings concerning a pair of shoes for right-handed people may be immediately transferred to the making of a pair of shoes for left-handed people.

A further difference between two shoes of a pair of shoes according to the invention is the position of the fastening means.

The first shoe DD,SS (the one comprising the rotary disc 3) comprises a hidden fastening means 13*a* being located on the outer side of said first shoe DD,SS, whereas the second shoe DS,SD comprises a hidden fastening means 13*b* being located on the median axis of said second shoe DS,SD.

It is understood that many other changes as to shape and materials may be made by the man skilled in the art to the sports shoes described herein without departing from the inventive idea resulting from this description and from the annexed claims.

The invention claimed is:

1. A pair of sports shoes, comprising:

a first shoe comprising a first sole fitted with first rotation means; and a second shoe comprising a second sole which is asymmetric with respect to said first sole of said first shoe, wherein said first rotation means comprises a rotary disc that can rotate independently of said first sole during a swing action, said rotary disc having its rotation axis located in a section of said first shoe intended to receive the big toe of a foot, and wherein said first and second soles comprise second rotation means comprising a rotating element that is movable independently of sole, and stopping means for stopping movement of said rotating element.

2. The pair of sports shoes according to claim 1, wherein said rotary disc comprises a plurality of elastic supports, or small elastic arms.

3. The pair of sports shoes according to claim 1, wherein said rotary disc comprises an interchangeable ground grip element.

4. The pair of sports shoes according to claim 1, wherein said rotating element comprises a spike comprising at least one anchor-shaped element.

5. The pair of sports shoes according to claim 1, wherein said second rotation means is located in an area of a foot bone toe, covering its surface.

6. The pair of sports shoes according to claim 5, wherein said second rotation means of said first sole comprises a plurality of spikes located in an area of the fourth metatarsus, of the fifth metatarsus, of the calcaneal anatomic periphery and of the base of the first metatarsus.

7. The pair of sports shoes according to claim 5, wherein said second rotation means of said second sole comprises a plurality of spikes located in the area of the base of the first metatarsus, of the calcaneal anatomic periphery, of the fifth metatarsus, of the fourth toe and of the big toe.

8. The pair of sports shoes according to claim 1, wherein said first sole of said first shoe comprises a second spike having a substantially triangular shape and substantially located in an area of the fourth, fifth and part of the third toe of the foot.

9. The pair of sports shoes according to claim 1, wherein said first sole of said first shoes fitted with a first torsional stabilizer element substantially located at the center of said sole, or in the mesopodalic area of the foot.

10. The pair of sports shoes according to claim 9, wherein said first torsional stabilizer element substantially has a Y shape, with two branches directed toward an area of the sole intended to receive a heel of said foot and a branch directed toward an area of the first sole intended to receive the base of the first metatarsus of the foot.

11. The pair of sports shoes according to claim 9, wherein said first torsional stabilizer element has a shape configured to follow torsional axiality of a foot substantially under load during a swing movement performed by a golf player.

12. The pair of sports shoes according to claim 9, wherein said first torsional stabilizer element is made of a material having a higher rigidity than the material of the base of said sole.

13. The pair of sports shoes according to claim 9, wherein said first torsional stabilizer element is made of carbon.

14. The pair of sports shoes according o claim 9, wherein said second shoe comprises a second torsional stabilizer element having a different shape from said first torsional stabilizer element of said first shoe, or said second torsional stabilizer element covering a smaller area of the second sole than said first torsional stabilizer element.

15. The pair of sports shoes according to claim 1, wherein said first shoe comprises a first flexure elastic element located in the upper half of said first sole and crossing said first sole in a direction transversal to the foot.

16. The pair of sports shoes according to claim 15, wherein said first flexure elastic element comprises an elastic segment that substantially starts from the center of said first flexure elastic element and then extends by following a curved line, to follow torsion of a foot substantially loaded during a swing action performed by a golf player.

17. The pair of sports shoes according to claim 16, wherein said elastic segment is directed toward an area of the sole intended to receive the fourth toe of the foot.

18. The pair of sports shoes according to claim 15, wherein said second shoe comprises a second flexure elastic element having a different shape from said first flexure elastic element of said first shoe, or said second flexure elastic element being a transversal band.

19. The pair of sport according to claim 1, wherein said first shoe comprises a first vamp stabilizer.

20. The pair of sports shoes according to claim 19, wherein said first vamp stabilizer is configured to block bending of a vamp of said first shoe in one or more areas of said vamp.

21. The pair of sports shoes according to claim 20, wherein said first vamp stabilizer comprises an edge attached to said sole and profiles rising from said edge and blocking said bending.

22. The pair of sports shoes according to claim 21, wherein said edge is attached onto said sole.

23. The pair of sports shoes according to claim 20, wherein said bending is controlled in an area of the first and/or fifth metatarsus and/or of the phalanx and/or of the inner and outer sides of the heel.

24. The pair of sports shoes according to claim 19, wherein said second shoe comprises a second vamp stabilizer configured to block bending of a vamp of said second shoe in one or more areas of said vamp, and wherein said second vamp stabilizer has a different shape from said first vamp stabilizer of said first shoe.

25. The pair of sports shoes according to claim 24, wherein said bending of the vamp of said second shoe is blocked by said second vamp stabilizer in an area of the first metatarsus and/or of the medial and lateral sides of the heel.

26. The pair of sports shoes according to claim 24, wherein said first vamp stabilizer has a concavity at a level of the outer side of the heel being sharper than a corresponding concavity present in said second vamp stabilizer.

27. The pair of sports shoes according to claim 1, wherein said first or second sole comprises a first layer of a first material laid on a second layer of a second material, said first material being softer than said second material, and said first layer directed toward the inside of said first or second shoe.

28. The pair of sports shoes according to claim 1, wherein said first or said second shoe comprise a hidden fastening means located either along the median axis or on the outer side of said shoe.

29. The pair of sports shoes according to claim 28, wherein said first Shoe comprises a first hidden fastening means located on the u side of said first shoe, and wherein said second shoe comprises a second hidden fastening means located on the median axis of said second shoe.

30. The pair of sports shoes according to claim 1, wherein said first or second shoe has an outer front profile and inner rear profile of the sole wedge-shaped, respectively rounded, and inner front profile and outer rear profile of the sole rounded, respectively wedge-shaped.

* * * * *